United States Patent [19]

Wells

[11] 4,188,033

[45] Feb. 12, 1980

[54] TETHERED BALL GAME WITH HELIX SUPPORT

[75] Inventor: John L. Wells, Rotorua, New Zealand

[73] Assignee: Zimm-Zamm Aktiengesellschaft, Zug, Switzerland

[21] Appl. No.: 826,183

[22] Filed: Aug. 19, 1977

[30] Foreign Application Priority Data

Aug. 26, 1976 [GB] United Kingdom ..... 35636/76

[51] Int. Cl.[2] ..... A63B 67/10

[52] U.S. Cl. ..... 273/413

[58] Field of Search ..... 273/95 A, 29 A, 26 E, 273/200 R, 184 B, 197 R, 197 A

[56] References Cited

U.S. PATENT DOCUMENTS

| | | | |
|---|---|---|---|
| 1,907,412 | 5/1933 | Zimmer | 273/184 B |
| 2,417,565 | 3/1947 | Norvell | 273/95 A |
| 3,730,526 | 5/1973 | Litzka | 273/95 A |
| 3,992,007 | 11/1976 | Seeman | 273/95 A |

FOREIGN PATENT DOCUMENTS

| | | | |
|---|---|---|---|
| 358792 | 10/1931 | United Kingdom | 273/200 R |
| 1354024 | 5/1974 | United Kingdom | 273/95 A |

*Primary Examiner*—Richard C. Pinkham
*Assistant Examiner*—Lawrence E. Anderson
*Attorney, Agent, or Firm*—Young & Thompson

[57] ABSTRACT

The invention is concerned with apparatus for indicating a win in a game comprising a pole supporting a helix and a ball on a line, the other end of the line being coupled by a line attachment to the helix, there being the possibility of relative movement between either the attachment and the helix or between the helix and the pole according to the direction in which the ball is hit, the indicating apparatus being coupled with the helix and being arranged to give an aural and/or visual signal when the line attachment has met either end of the helix or when the helix has reached either of its predetermined limits of travel.

2 Claims, 5 Drawing Figures

TETHERED BALL GAME WITH HELIX SUPPORT

This invention relates to games of the kind comprising a pole supporting a helix and a ball on a line, the other end of which is coupled by means of a line attachment to the helix, there being the possibility of relative movement between either the line attachment of the ball and the helix or between the helix and the pole, according to the direction in which the ball is hit.

Arguments frequently ensue between players as to whether the line attachment has met the end of the helix (which would indicate the end of a particular game) before the player defending that end of the helix has managed to reverse the direction of the ball and therefore the movement of the line attachment relative to that end of the helix.

It is an object of the present invention to obviate such arguments.

According to the invention means are provided coupled with the helix adapted to emit a signal when the line attachment has met either end of the helix or when the helix has reached either of its predetermined limits of travel. In the preferred form of the invention a sleeve element is provided which is slidable on the pole inside the helix between a first or cocked position in which triggering formations associated therewith are adjacent to both ends of the helix and a second or released position to which the sleeve element is impelled as a result of contact of the line attachment with one or other of the triggering formations, whereby the sleeve element is released from its cocked position, such movement causing a signal to be emitted and/or constituting a signal.

The sleeve elements may be spring-loaded in the cocked position and may include means releasably for supporting it in that position. Such means may comprise a slot in the sleeve element co-operating with a pin or the like (preferably the bottom end of the helix) mounted on the pole and extending through the slot, the slot being adapted, when the sleeve element is moved to is cocked position, to cause a sufficient twist of the sleeve element of the spring action to urge a cradle portion of the slot against the pin when the cocking force is released, whereby the sleeve element is supported in its cocked position. The slot is preferably of inverted U-shape with the cradle portion immediately beneath the apex of the inverted U. The U may have a centrally-located bay immediately above the cradle for receiving and centering the pin prior to release of the cocking force so that the spring action urges the pin directly into the cradle where it is held in a cocked position.

The action of the line attachment during play, on contacting one or other of the sleeve formations, is just sufficient to cause sufficient twist of the sleeve element to unseat the pin from the cradle so that the sleeve element is snapped by the spring means into the released position, thereby causing a percussive noise due to either the pin reaching the end of its travel in the slot or by actuating other suitable means such as bells, gongs or the like, as well as constituting a visual signal by virtue of its rapid movement to the released position which raises the top of the sleeve element to above the helix.

The sleeve may be cocked by pressing down with the palm of the hand or, for smaller players, by pulling on a skirt of the sleeve element at the botton end where a suitable projection or flange may be provided. For very small players a cord or the like may be attached to the sleeve so that it can be pulled downwards to its cocked position.

The formations may take the form of upper and lower lugs or ears located and spaced apart on the sleeve element so that in the cocked position of the sleeve element they are adjacent to both ends of the helix. The lower lug should be located so that, when the sleeve element is in its released position, it is between adjacent coils and offers no obstruction to the passage of the line attachment. The upper lug will, of course, be well above the top of the helix in its released position and will not be able to interfere with the movement of the line attachment. Players of the game not wishing to use the sleeve element for signalling a win may, by virtue of this arrangement, be able to play the game without any interference from the sleeve formations.

In a refinement of the game a brightly coloured band may be located on the pole just covered by the lower end of the sleeve formation when the sleeve formation is in its cocked position and not covered when the sleeve formation is in its released position. Thus, the band is suddenly exposed when the sleeve snaps up into its released position. This constitutes an additional conspicuous visual signal which adds to the other visual and aural signals referred to above. The band may be marked with the legend "WIN", or the like.

In another preferred form of the invention lengths of coil spring or other flexible members are provided which are arranged lightly to rest on the top and bottom coils of the helix. The coil springs may be attached to a pole supporting the helix and extending therethrough and will extend substantially at right angles thereto to lie on the top and bottom coils. In playing the game the line attachment (which is preferably a plastics ring), slides up and down the coils of the helix and will not be able to meet either of the coil springs without displacing it. The act of displacement will cause the spring to jerk to create a highly conspicuous signal. As the line attachment passes the coil spring, the latter will snap back and thereby emit a twang. In addition, the arrangement may be such that the coil spring will continue to vibrate for a time, thus giving both a visual and aural signal. The visual signal may be enhanced by locating a colourful marker at the free ends of the coil springs. If the game is stopped at the stage when the line attachment has by-passed the coil spring it will be apparent to both players that the line attachment is in the winning position. In play it will frequently happen that a winning shot is achieved but the opponent manages to return the ball before the line attachment has completely passed under the coil spring. However, the coil spring might well have been partially deflected before returning to is normal position, which movement will show up, thus greatly adding to the excitement of the game.

Further according to the invention the coil springs may also be fitted with sounding devices which in addition to being visually distinctive are designed to amplify the clicking or twanging noise referred to above.

Other means for signalling the end of the game may comprise switching means to actuate a lamp, bell or similar visual or aural devices, such as leaf springs located at either end of the helix at an angle thereto, preferably on the inside of the helix, the angle being away from the direction in which the line attachment is travelling when approaching either the top or bottom of the helix (i.e. approaching a "win"). The angle is such that the passage of the line attachment causes the leaf spring to be bent flat towards the helix which does not, however, materially impede the passing of the line attachment when travelling in this direction. When the line attachment has slipped completely past the leaf spring, the leaf spring immediately snaps back to its original position which may be so designed as to set up a vibratory motion which induces a noise like a twang. This arrangement has the advantage that the winning of the game is indisputably indicated by the fact that the line attachment, having slipped past the leaf spring on the winning stroke cannot be hit back past the leaf spring because it comes up against the angle of the leaf spring which permits the passage of the line attachment in only one direction (.i.e. in the direction of a "win"). The line attachment is thus clearly located in the winning position and the game cannot proceed until a player presses the leaf spring down flush with the spiral and passes the line attachment back so that a new game may be started.

As a further alternative in games in which the helix is located on top of a supporting pole without the pole extending therethough, a simple strip of metal, preferably of flexible spring steel, or a coil spring, may be located on the helix running at right angles internally across the coil of the helix so that it nearly touches the lower coil on the inside of the helix on the far side.

An embodiment of the invention is described below with reference to the accompanying drawings in which.

Referring firstly to FIGS. 1 to 4, FIGS. 1,2, 3 and 4 show a helix 10 carried by a pole 12. A line 14 whose free end is attached to a ball is coupled to the helix by means of a line attachment 16. The players hit the ball in opposite directions and should one of the players miss the ball his opponent will cause the line attachment to move up or down the helix according to which direction he is playing.

Figure 1:
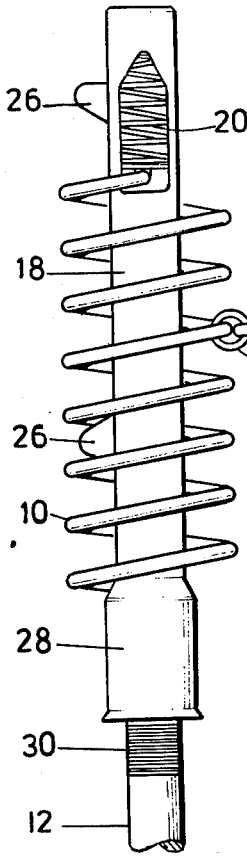
FIGS. 1 to 3 are side views of the preferred form of the invention, FIG. 1 being from one side and FIGS. 2 and 3 from the other side and showing the sleeve element in its cocked (FIG. 3) and released positions (FIGS. 1,2).
Figure 2:
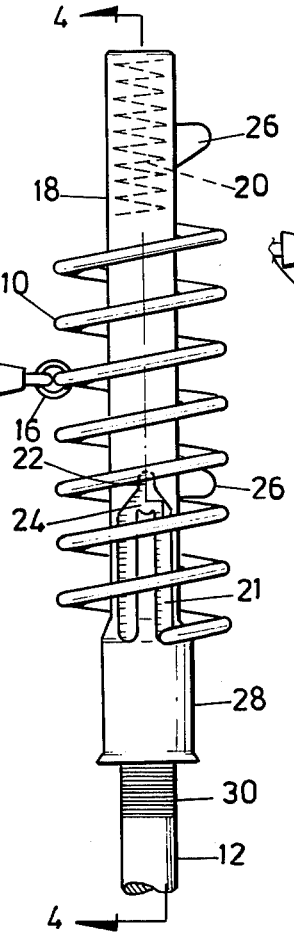
Figure 3:
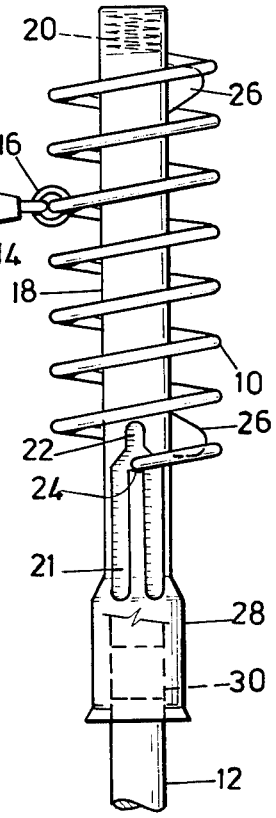
Figure 4:
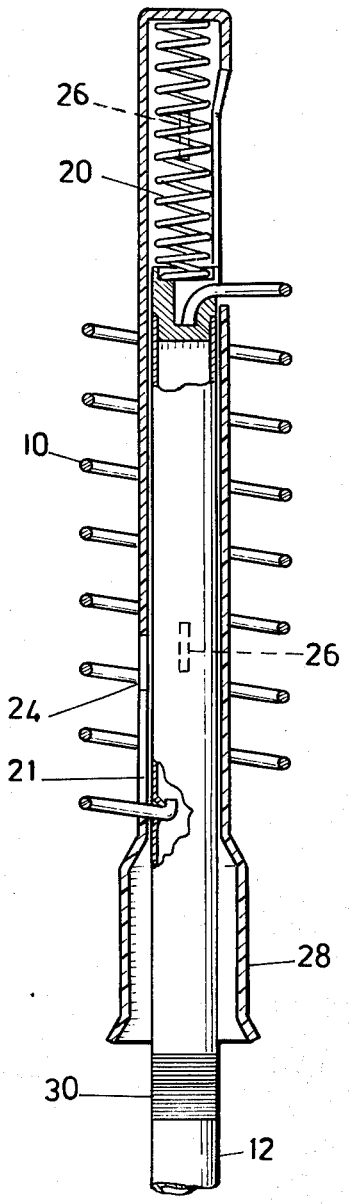
FIG. 4 is a cross-sectional side view of FIG. 2.

A sleeve element 18 is provided which is slidable on the pole 12 within the helix 10 and it has a compression spring 20 between the top of the pole 12 and the top of the sleeve element 18, thus biasing it to the (released) position shown in FIGS. 1 and 2. FIG. 3 shows the sleeve element 18 in its first or cocked position.

Referring to FIGS. 2 and 3 it will be seen that the sleeve element 18 has a slot 21 in the form of an inverted U. The bottom end of the helix 10 passes through the slot and is anchored to the pole 12. Thus the sleeve element is held captive on the pole.

On depressing the sleeve element 18 the end of the helix moves up the slot until it is forced into the bay 22. On release of the sleeve element, the spring 20 urges the sleeve element so that the end of the helix rests in cradle 24. The sleeve element is then in the cocked position as shown in FIG. 3 and triggering lugs 26 are now adjacent the coils of the helix at top and bottom thereof. When the line attachment 16 contacts one or other of the lugs 26 with sufficient force, there is a triggering action; the cradle 24 is displaced fron beneath its end of the helix and the spring causes the sleeve element to snap up into the released position where it comes to rest with a pronounced and unmistakable clatter. The popping up of the top end of the sleeve above the top of the helix provides a most conspicuous visual signal as well.

The bottom of the sleeve element has a skirt 28 so that smaller players may pull the sleeve downwardly to its cocked position.

A coloured band 30 is located inside the bottom end of the sleeve element when in its cocked position, as described above. The band 30 is exposed suddenly when the sleeve element snaps up to its released position.

Figure 5:
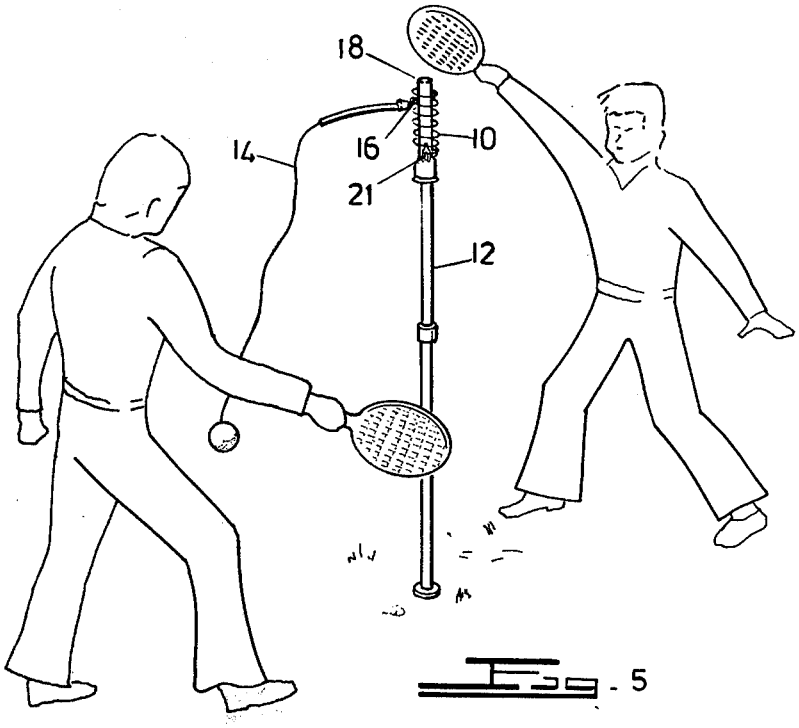
FIG. 5 is a general perspective view of a game incorporating the preferred form of the invention.

FIG. 5 shows a game incorporating the invention. The pole 12 is pushed into the ground by means of its point and the game is played by two persons hitting the ball in opposite directions.

I claim:

1. Apparatus for a game comprising a pole supporting a helix and a ball on a line, the other end of the line being coupled by a line attachment to the helix, there being the possibility of relative movement between the line attachment and the helix according to the direction in which the ball is hit, characterised by the provision of a slidable element inside the helix, the element being supportable in a cocked position, and triggering formations are provided at each of the end positions of the helix, the triggering formations being releasable for abrupt uncocking action by movement of the line attachment into either of its two end positions, to provide a perceptible signal.

2. Apparatus according to claim 1 in which the slidable element is a sleeve spring-loaded in its cocked position, the sleeve including a slot adapted to cooperate with a pin on the pole which extends through the slot, the slot having a cradle for the pin, the sleeve having formations corresponding to the end positions of the helix, adapted to be contacted by the line attachment to cause twisting of the sleeve sufficient for the cradle to be displaced from beneath the pin and for the sleeve to be abruptly snapped to its released position under the influence of the spring means.

* * * * *